United States Patent [19]

Sarcia

[11] 4,333,755

[45] Jun. 8, 1982

[54] CRYOGENIC APPARATUS

[75] Inventor: Domenico S. Sarcia, Carlisle, Mass.

[73] Assignee: Oerlikon-Buhrle U.S.A. Inc., New York, N.Y.

[21] Appl. No.: 248,988

[22] Filed: Mar. 30, 1981

Related U.S. Application Data

[63] Continuation-in-part of Ser. No. 89,274, Oct. 29, 1979, Pat. No. 4,305,741.

[51] Int. Cl.[3] ..... F25B 9/00

[52] U.S. Cl. ..... 62/6; 137/625.37

[58] Field of Search ..... 62/6; 137/625.37

[56] References Cited

U.S. PATENT DOCUMENTS

| | | | |
|---|---|---|---|
| 2,906,101 | 9/1959 | McMahon et al. | 62/6 |
| 2,966,035 | 12/1960 | Gifford | 62/6 |
| 3,119,237 | 1/1964 | Gifford | 62/6 |
| 3,188,821 | 6/1965 | Chellis | 62/6 |
| 3,218,815 | 11/1965 | Chellis | 62/6 |
| 3,421,331 | 1/1969 | Webb | 62/6 |
| 3,600,903 | 8/1971 | Chellis | 62/6 |
| 3,609,982 | 10/1971 | O'Neil et al. | 62/6 |
| 3,620,029 | 11/1971 | Longsworth | 62/6 |
| 3,738,837 | 5/1973 | Lobb | 62/6 |
| 3,780,088 | 1/1974 | Dehle | 62/6 |
| 3,853,147 | 12/1974 | Blair | 137/625.37 |
| 4,108,210 | 8/1978 | Luthe et al. | 137/625.37 |
| 4,259,844 | 4/1981 | Sarcia et al. | 62/6 |

*Primary Examiner*—Ronald C. Capossela

*Attorney, Agent, or Firm*—Schiller & Pandiscio

[57] ABSTRACT

A cryogenic refrigerator is disclosed which essentially comprises a cylinder, a displacer slidably mounted within the cylinder so as to form a chamber whose volume varies with movement of the displacer, drive means mechanically connected to the displacer for causing the displacer to reciprocate, and valve means for continuous flow of a refrigerant fluid into and out of the chamber, the valve means being operable by said displacer so as to (a) cause high pressure refrigerant fluid to enter the chamber during a first selected portion of the displacer's operating stroke and (b) exhaust low pressure fluid from the same chamber during a second selected portion of the displacer's operating stroke.

16 Claims, 8 Drawing Figures

CRYOGENIC APPARATUS

This application is a continuation-in-part of my copending U.S. Application Ser. No. 089,274, filed Oct. 29, 1979 for Cryogenic Apparatus now U.S. Pat. No. 4,305,741 issued Dec. 15, 1981.

This invention relates to cryogenic refrigeration and more specifically to an improved form of cryogenic refrigerators.

BACKGROUND OF THE INVENTION

A number of different types of apparatus have been developed to satisfy the increasing demand for cryogenic refrigeration. These devices, all based upon the controlled cycling of an expansible fluid with suitable heat exchange to obtain refrigeration, are exemplified by U.S. Pat. Nos. 2,996,034, 2,996,035, 3,274,786, 3,333,433, 3,312,239, 3,321,926, 3,625,015, 3,673,809, 3,717,004, 3,733,837, 3,788,088, 3,802,211, 3,884,259, 4,036,027, 4,078,389 and 4,118,943, the prior art cited in those patents, and British Pat. No. 1,352,153.

The present invention is directed to an improved form of refrigeration system suitable for performing the refrigeration cycle described in U.S. Pat. Nos. 2,996,035 and 3,625,015.

The refrigeration cycle of U.S. Pat. No. 2,996,035 requires that a high pressure fluid be introduced into a "warm" chamber and flow along a heat storage path into at least one "cold" expansion chamber of variable volume, with the volume of the latter chamber being varied by movement of a displacer and the fluid being discharged at a low pressure into a low pressure fluid reservoir or into the inlet of a compressor. In such a cycle, the control of fluid flow and movement of the displacer must be continuously and accurately timed, with the action of the valves controlling the fluid flow being appropriately coordinated with movement of the displacer.

In the apparatus of U.S. Pat. No. 3,625,015, reciprocal movement of the displacer is achieved by a mechanical driving means, while the valving controlling the fluid flow is achieved by a rotary valve which is mechanically linked to the drive means for the displacer.

While the rotary valve arrangement is reliable, it is relatively complicated and is interposed between the Scotch yoke crank which drives the displacer and the main drive shaft which couples the Scotch yoke crank to the electric motor which serves as the prime mover for the refrigerator.

OBJECTS AND SUMMARY OF THE INVENTION

The primary object of the present invention is to improve upon the apparatus of U.S. Pat. No. 3,625,015 by replacing the rotary valve with a new valve which has a relatively simple construction, is relatively small, easy to remove for inspection, does not affect the connection of the Scotch yoke with the prime mover, and is operated directly by the displacer rather than by the prime mover.

A more particular object of the invention is to provide cryogenic refrigerators which can be made in various cooling capacities, are relatively small and easy to disassemble and repair, and provide a controlled cooling cycle. The term "refrigerator" is used herein in a generic sense and is meant to also include a liquefier.

A further and more specific object of the invention is to provide an improved refrigerator of the type having a mechanically driven displacer, which is characterized by novel valving arranged for operation by the displacer so that the direction of gas flow (injecting or exhausting) is reversed only when the displacer is substantially at the end of its upward or downward stroke, thereby assuring high gas volume transfer through the regenerator and consequently better refrigeration efficiency.

In its preferred embodiment the apparatus of this invention is a refrigerator which includes the following: a cylinder, a displacer movable within the cylinder, first and second chambers of variable volume defined by the cylinder and the displacer, drive means mechanically coupled to the displacer for causing it to reciprocate within the cylinder so as to alternately increase and decrease the volume of the first and second chambers, thermal storage means associated with the first and second chambers respectively so as to permit flow of fluid between those first and second chambers, a heat exchanger means associated with the second chamber, and valve means in the form of a slide valve operatively coupled to the displacer for injecting refrigerant fluid to and removing refrigerant fluid from the first chamber in accordance with movement of the displacer. The displacer undergoes controlled reciprocating motion, with the motion of the displacer means consisting of four steps as follows: (A) stopping in a first limit position; (B) moving from that first limit position to a second limit position; (C) stopping in the second limit position; and (D) moving back to the first limit position. The slide valve means causes high pressure fluid to enter the first chamber during two consecutive steps of the displacer motion and exhaust low pressure fluid from the first chamber during the two other consecutive steps of the displacer motion. The valve means comprises a reciprocal valve member operated solely by the displacer as the latter approaches its first and second limit positions, and a valve casing in which the reciprocal valve member is slidably mounted, the valve casing being mounted within a header, and the reciprocal valve member being arranged to slidably accommodate a shaft which operatively couples the displacer to the drive means.

Other features and many of the attendant advantages of the invention are described or rendered obvious by the following description of a preferred and alternative embodiments of the invention which are to be considered together with the accompanying drawings:

BRIEF DESCRIPTION OF THE DRAWINGS

Unless otherwise indicated, the same reference characters are used to refer to the same parts throughout the different views. The drawings are not necessarily to scale, emphasis instead being placed upon illustrating principles of the invention in a clear manner.

DESCRIPTION OF THE ILLUSTRATED EMBODIMENTS OF THE INVENTION

Figure 1:
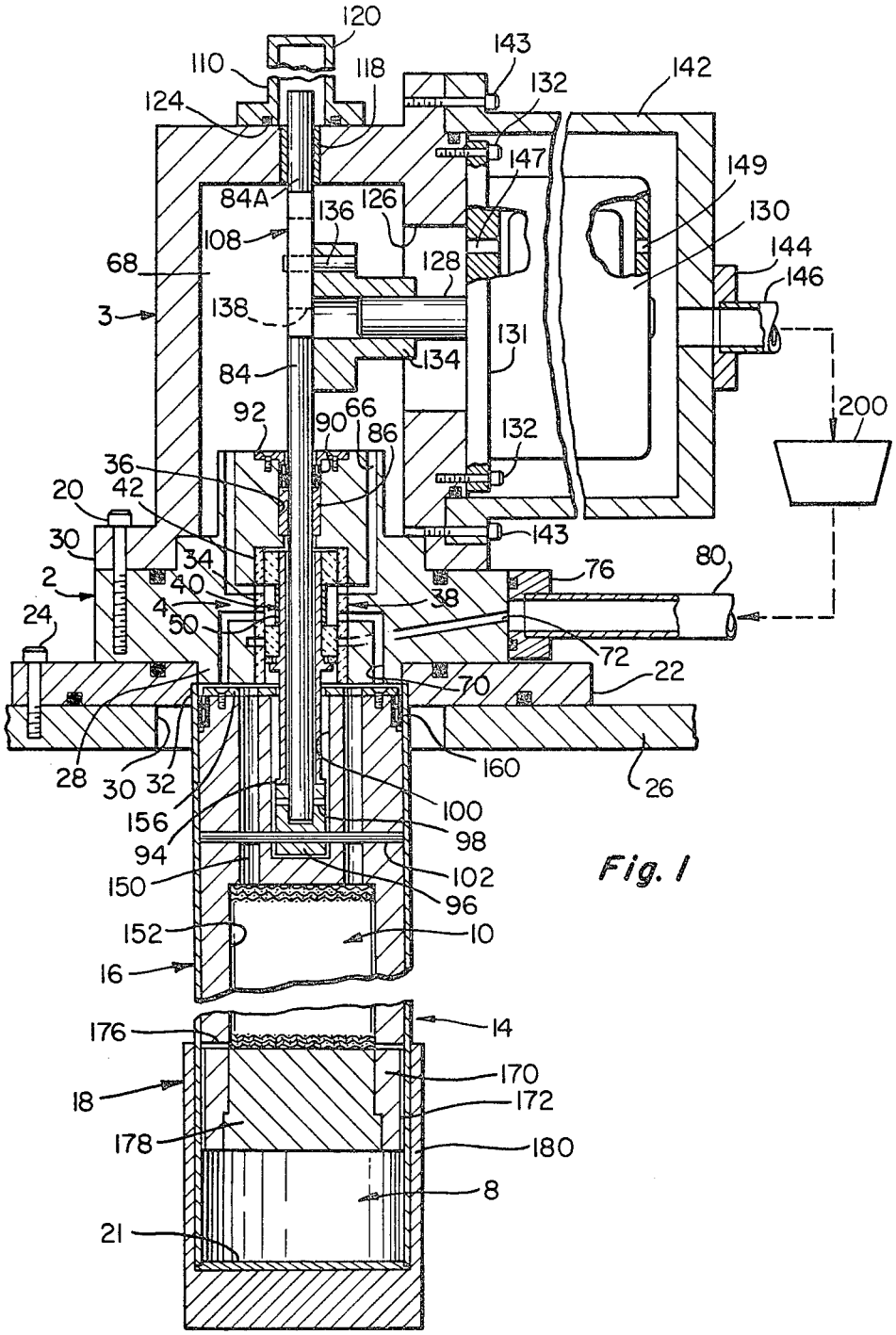
FIG. 1 is an enlarged longitudinal sectional view of a preferred embodiment of the invention constituting a Gifford-McMahon cycle cryogenic refrigerator, showing the displacer and control valve mechanisms in a first limit position.

In the following detailed description of the illustrated embodiments of the invention, descriptive words such as "upper", "lower", "warm", "cold" and the like are used for convenience and in a relative sense. Moreover it is to be understood that the refrigeration apparatus may be oriented in any manner, and the position shown in the drawing is for convenience in presenting the following description and also because that orientation is the one usually encountered in practice. Also, although helium gas is the preferred working fluid, it is to be understood that the present invention may be practiced with other gases according to the refrigeration temperatures that may be desired, including but not limited to air and nitrogen.

Referring now to FIGS. 1-4, the preferred embodiment of the invention comprises a metal header assembly consisting of a header body 2 and a header cap 3. The header body 2 accommodates and supports a control valve 4 which is used to control the flow of a selected refrigerant fluid in gaseous form, e.g., helium, to and from two variable volume chambers 6 (FIG. 4) and 8 (FIG. 1) via a thermal regenerator 10 which is associated with a displacer 14 mounted within a metal cylinder 16 carrying a heat exchanger 18. The header body 2 is provided with openings for accommodating screws 20 which pass through holes in a flange 30 on cap 3 and screw into threaded holes in a circular mounting ring 22, so that the header body, cap and mounting ring are connected to one another as a unit. This unit is secured by means of screws 24 to a mounting plate 26. Ring 22 has a center opening sized to snugly accommodate a short extension 28 of the header body 2, while plate 26 is provided with an enlarged opening 30 for accommodating the cylinder 16. The upper end of the cylinder 16 is mounted within a counterbore 32 in ring 22 and is secured to that ring by appropriate means, preferably by welding or brazing. Consequently, cylinder 16, ring 22, cap 3 and header body 2 form a discrete sub-assembly.

Figure 2:
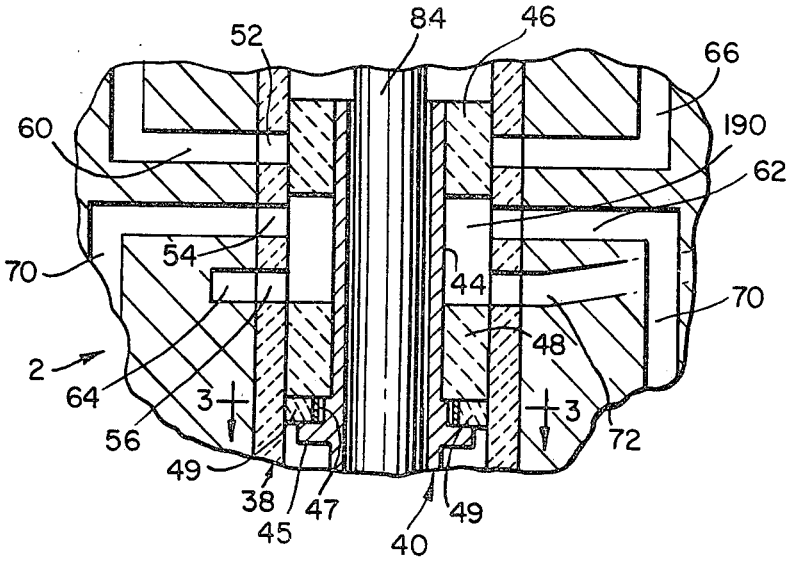
FIG. 2 is an enlargement of a portion of FIG. 1.

The header body 2 is provided with a longitudinally extending bore 20 of varying diameter. As seen in FIGS. 1 and 2, the bore comprises a lower section 34 of major diameter, an intermediate section of relatively small diameter, and an upper section 36 of a diameter intermediate that of the lower and intermediate sections.

Mounted within lower bore section 34 is a slide valve casing 38 which together with a slide valve member 40 constitutes the control valve 4. Valve casing 38 is sized so as to make a snug fit within the larger diameter bore section 34 and is held in place by a roll pin, e.g., as shown at 42, or by other suitable fastening means, e.g., a screw thread connection or a set screw. In the illustrated embodiment valve casing 38 is made of a ceramic material and slide valve member 40 consists of a metal sleeve 44 having attached thereto on its outer surface first and second ceramic rings 46 and 48 separated by a metal spacer sleeve 50. Ceramic rings 46 and 48 are sized to make a close sliding fit within the valve casing 40. Sleeve 44 has a flange 45 which coacts with ring 48 to retain a circular wavy washer-like spring 47 and a surrounding friction ring 49. Spring 47 holds friction ring 49 against valve casing 38 with the result that valve member 40 will not move relative to valve casing 38 unless it is forced to so do by the displacer, as described below. Ring 49 may be made of any suitable resilient material, e.g., a metal, rubber, or a plastic having a suitable coefficient of friction relative to the valve casing. A wide choice of materials is available for ring 49 since the valve is not chilled to any substantial extent.

Still referring to FIGS. 1 and 2, valve casing 38 is provided with three axially-spaced pluralities of radial ports 52, 54 and 56 of identical size. Ports 52 are the low pressure exhaust ports, ports 54 are transfer ports, and ports 56 are high pressure inlet ports. Preferably each plurality of ports totals an even number with the ports arranged so that each port is in diametric opposition to another port. Such an arrangement helps assure that the fluid pressure around valve member 40 will be uniform, so that the valve member will not be forced laterally tight against casing 38 to create a drag force which will hinder proper operation of the valve.

Formed in the header body 2 in alignment with radial ports 52, 54 and 56 are three circumferentially extending grooves 60, 62 and 64 respectively. Groove 60 communicates with several circumferentially displaced passageways 66 which terminate at the upper end of the header body 2 and communicate with a chamber 68 formed between the upper end of header body 2 and cap 3. The next lower annular groove 62 connects with a plurality of passageways 70 which lead to the chamber 6. The lowest annular groove 64 connects with a passageway 72 which leads to an inlet port 74 formed by a fitting 76 attached to the header body 2. Fitting 76 is adapted to be connected to a conduit 80 which leads to a source of high pressure gas.

Still referring to FIGS. 1 and 2, sleeve 44 of slide valve member 40 surrounds a shaft 84 which is slidably mounted within the header body 2 by virtue of a bearing 86 which is mounted within the upper bore section 36. Located above bearing 86 is a sealing member 90 which slidably and hermetically seals the shaft from the header body 2. Seal 90 is retained in place by a retaining plate 92 which is held in place by screws attached to the header body 2.

Sleeve 44 of slide valve member 40 is sized so that it does not engage shaft 84. The lower end of sleeve 44 is enlarged so as to form a flange 94. Shaft 84 extends through sleeve 44 into a blind hole in a plug 96 and the two are secured together by a roll pin 98. Preferably plug 96 has about the same outer diameter as flange 94 so as to act as a stop for the valve member.

The lower end of valve sleeve 44 and base 94 extend into a bore 100 formed in the upper end of the displacer 14. A roll pin 102 disposed in aligned openings in the displacer and plug 96 serves to lock the displacer to shaft 84 so that they move as a unit relative to cylinder 16.

The upper end of the shaft 84 is secured to a scotch yoke 108 having an elongated horizontal slot 110 terminating in circularly curved and slightly enlarged ends 112. One side of yoke 108 is provided with a groove 114 to slidably accommodate the end of a guide screw 116 which is screwed into a hole in cap 3 and coacts with the yoke to prevent rotation of shaft 84. Attached to the upper end of yoke 108 and serving as an extension of shaft 84 is another shaft 84A. The upper end of shaft 84A is slidably mounted in a bearing 118 which is disposed within a hole in the cap member 3. An auxiliary cap 120 is attached to cap member 3 and is adapted to accommodate the upper end of shaft 84A when the latter reaches the upper end of its operating stroke. A seal 124 hermetically seals off the cap member 110 so as to retain fluid pressure in chamber 68.

Still referring to FIGS. 1 and 2, one of the side walls of the cap member 3 is provided with an opening 126 through which extends the operating shaft 128 of an electric motor 130 which serves as the prime mover of the apparatus. Attached to the free end of shaft 128 is a crank hub 134. Motor flange 131 is attached to cap 3 by means of screws 132. Eccentrically mounted to the crank hub 134 is a crank pin 136 which has a roller 138 that is disposed in groove 110 in yoke 108. Motor 130 is enclosed by a housing 142 which is secured to the cap member by suitable means, e.g., by screws 143. Housing 142 is provided with a fitting 144 for attachment to a conduit 146 which serves as the exhaust outlet line for low pressure fluid. Passageways 147 and 149 in motor 130 allow low pressure fluid to flow from chamber 68 through motor 130 and housing 142 to conduit 146.

It is to be appreciated from the foregoing description that when the motor 130 is energized, shaft 128 will rotate, and as it rotates the scotch yoke connection will cause shaft 84 to reciprocate. Shaft 84 reciprocates so that the displacer 14 moves between a first limit position (FIG. 1) wherein the displacer is uppermost in cylinder 16 just short of touching extension 28 and a second limit position (FIG. 2) wherein the displacer 14 is lowermost in the cylinder 16 just short of touching the metal end wall 21 of cylinder 16.

Figures 4, 5:
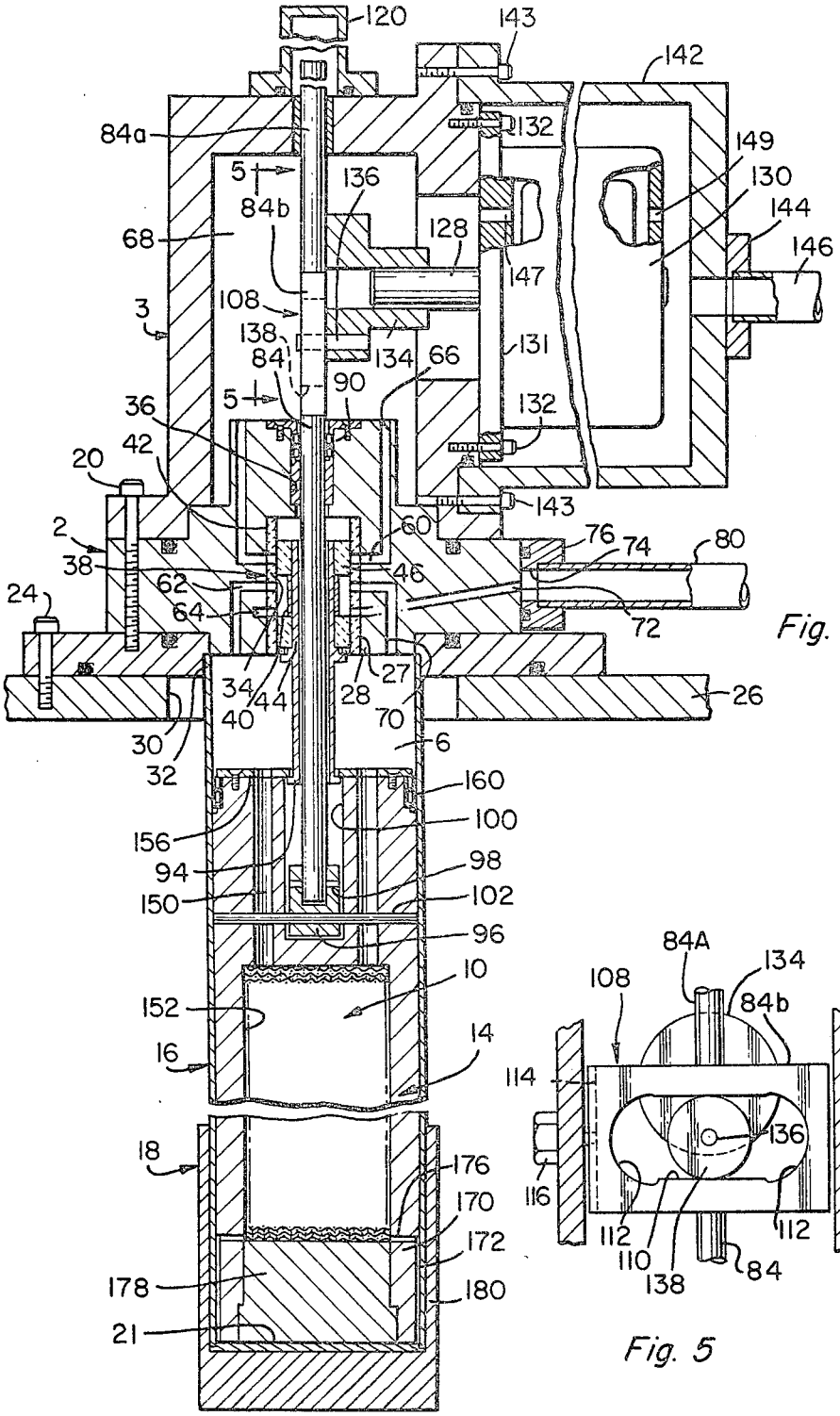
FIG. 4 is a view similar to FIG. 1 illustrating the control valve mechanism and a portion of the displacer in a second limit position.
FIG. 5 is a sectional view taken along line 5—5 of FIG. 4.

Still referring to FIGS. 1 and 4, the displacer 14 includes a plurality of passageways 150 which connect with an interior chamber 152 which contains the regenerator 10. The latter may be of various forms, for example, consisting of or comprising bronze screens, lead shot or other material having a high thermal conductivity, according to the desired cooling temperature. The upper end of the displacer 14 is closed off by a perforated annular plate 156 which is attached thereto by suitable screws and serves as a retainer for a resilient seal 160. For convenience of assembly, plate 156 consists of two semi-circular sections. Plate 156 has apertures aligned with passageways 150. The latter is disposed in a peripheral groove in the upper end of displacer 14 and makes slidable engagement with the interior surface of cylinder 16, so as to prevent escape of gas between the displacer and the inner surface of the cylinder 16 at the upper end of the displacer. The inner diameter of retainer plate 156 is oversized relative to the outer diameter of sleeve 44, so as to allow slide valve member 40 to move freely relative to the displacer. However, it is smaller than the outer diameter of flange 94, so as to be engageable with that flange when the displacer moves downward, e.g., as shown in FIG. 4 and thus act as a stop for the valve member.

The lower end of the displacer has a reduced diameter section 170 which is spaced from the interior surface of cylinder 16 so as to form an annular gap 172. Gap 172 and the fluid which passes through it form an internal heat exchanger for removing heat from the surrounding portion of housing 16. At the junction of the reduced diameter section 170 with the remainder of the displacer 14, the latter is provided with a series of radial ports 176 which provide communication between the annular gap 172 and the interior chamber 152. The lower end of the chamber 152 of displacer 14 is closed off by a plug 178 which preferably is made of a high thermal conductivity material. The plug 178 is secured to the displacer 14 by suitable means, e.g., by screws, brazing or welding.

Still referring to FIGS. 1 and 4, an external heat exchanger 18 carried by metal cylinder 16 comprises a body 180 of high thermal conductivity which is cup-shaped and is attached to the lower end of the cylinder 16 in contact with the high thermal conductivity of end wall 21. Although not shown, it is to be appreciated that the lower end of the external heat exchanger body 180 is connected to whatever apparatus is to be cooled, e.g., an infrared detector or a vacuum chamber.

Still referring to FIGS. 1–4, valve sleeve 44 has a smaller outer diameter than the ceramic rings 46 and 48, thereby providing an annular groove 190. Preferably the axial length of groove 190 is such that when the valve member is in its upper limit position (FIG. 1), the upper end of the groove is flush with the upper edges of radial ports 52 while the opposite end of the same groove is below the lower edges of ports 54, thereby providing communication between chamber 68 and the variable volume chamber 6. However, when the valve member is in its lower limit position (FIG. 2), the lower end of the annular groove 190 is flush with the lower edges of radial ports 56 while its upper end is above the upper edges of ports 54, thereby providing communication between conduit 80 and variable volume chamber 6. When the valve member is in its upper limit position, conduit 80 is closed off from chamber 6. When the valve member is in its lower limit position, chamber 68 is closed off from chamber 6. The limit positions of valve member 40 are determined by the extent to which the valve member is moved in one direction or the other by the displacer, since the friction between ring 49 and valve casing is set so that the valve member will move only if and so long as the displacer forces it to move. If desired the length of groove 190 may be changed, e.g., it may be shortened so that (a) when the valve is in its upper limit position (FIG. 1) the upper and lower ends of the groove will be flush with the upper edges of ports 52 and the lower edges of ports 54 respectively, and (b) when the valve is in its lower limit position (FIG. 2) the upper and lower ends of the groove will be flush with the upper edges of ports 54 and the lower edges of ports 56 respectively.

Operation of the apparatus involves supplying a high pressure fluid from a suitable source, e.g., the discharge side of a compressor 200 through line 80 and exhausting low pressure fluid to a low pressure reservoir, e.g., the inlet side of compressor 200, via line 146.

Operation of the apparatus disclosed in FIGS. 1–3 will now be described starting with the assumption that the slide valve member 40 is in its bottom limit position (FIG. 4) and displacer 14 is moving upward, with the upper end of the displacer located at a point, just short of its top dead center position, where plug 96 first engages flange 94 at the bottom end of the slide valve member.

When the displacer 14 is located just short of its top dead center position as just described, the fluid pressure and temperature conditions in the refrigerator are as follows: (A) Chamber 6 is at high pressure and room temperature; and (B) Chamber 8 is at a high pressure and low temperature. As the displacer continues moving up, plug 96 engages flange 94 of slide valve member 40 and shifts the latter upward. Valve member 40 reaches its top limit position (FIG. 1) as the displacer reaches its top dead center position. When the slide valve member moves from its bottom limit position to its top limit position, or vice versa, it moves through a transition point. In this transition point the lower edge of the groove 190 is even with the upper edges of ports 56, while the upper edge of the same circumferential groove is even with the lower edges of ports 52. When the slide valve member passes its transition position, fluid commences to exhaust from the chamber 6 to the port 146 via passages 70 and 66 and the chamber 68, thus reducing the pressure in the chambers 6 and 8. When the slide valve member is in its upper limit position (FIG. 1) and the displacer is in its top dead center (TDC) position, cold high pressure gas in chamber 8 will exhaust through the regenerator 10 and the warm chamber 6 respectively. As the gas is exhausted, it gets heated up by the matrix of the regenerator, thus cooling the latter. Now as the displacer starts to move down, which occurs after the valve member has reached its upper limit position, the valve member will remain in its upper limit position and the displacer will force low pressure cold fluid from chamber 8 and the valve will continue to exhaust low pressure gas from chambers 6 and 8. The regenerator cools down further as it gives up heat to the remainder of the cold gas displaced from chamber 8. The cold gas flowing through the regenerator 10 expands on heating, thus cooling the reegenerator further. As the displacer nears its bottom dead center (BDC) position, the retainer 156 will intercept the slide valve member and move it down through its transition position to its bottom limit position (FIG. 4).

When the valve member moving downward passes its transition position, high pressure fluid from the conduit 80 will flow into the chamber 6 via the passageways 72 and 70, thus causing that chamber to be filled with high pressure, low temperature gas which will flow through the regenerator into the chamber 8. As the warm gas flows into the chamber 8, it is cooled on passing through the cold regenerator 10. The pressure in chambers 6 and 8 increases as high pressure gas is pumped via the conduit 80. The displacer reaches its lower limit position and then, through the action of the crank, begins to move upward again. As the displacer moves up it causes more high pressure, room temperature gas to flow from the conduit 80 into the chamber 8 via the chamber 6 and the regenerator 10, with the result that this additional gas is cooled as it passes through the regenerator and is caused to contract in volume. This reduction in volume allows more gas to be sucked into the chamber 8 as the displacer moves upward.

As the displacer moves back up to its TDC position, it again encounters and shifts the slide valve member to its top limit position, thus causing the gas in chambers 6 and 8 to be exhausted again via chamber 68, passageways 147 and 149, and line 146.

The cycle of operation just described is repeated as the displacer continues to be reciprocated by the prime mover. It should be noted that as the displacer reaches its TDC position, the system again will have cold high pressure gas in chamber 8, and room temperature high pressure gas in chamber 6.

The invention has many obvious advantages in addition to those already noted, including the fact that the construction may be varied in a number of ways to suit available manufacturing techniques and performance requirements. The internal and external heat exchangers, which may take other forms, are simple, reliable and efficient. A further advantage results in the fact that the regenerator 10 also may take various forms, e.g., screens or lead shot as previously described, depending upon the temperature to which the gas is to be cooled.

Still another advantage resides in the fact that the displacer may be made of plastic or metal. Furthermore, it is to be appreciated that the thermal regenerator may be mounted exterior of the cylinder 16, e.g., as shown in FIG. 5 of British Pat. No. 1,352,153, in which case the displacer may be a solid member, or a hollow member closed at both ends, and suitable conduits may be provided at the upper and lower ends of the cylinder 16 providing communication to the exterior regenerator.

A further obvious modification is to provide other mechanical means for reciprocating the displacer, e.g., an automatically reversing electric motor or a pneumatic or hydraulically operated actuator, e.g, a double acting pneumatic actuator connected directly to shaft 84A. A further possible modification is to change the construction of the slide valve, e.g., by providing mechanical stops for stopping the slide valve member when it reaches its limit positions. Also the device may be a two or three stage device, e.g., according to the teachings of U.S. Pat. Nos. 3,802,211 and 4,036,027 and British Pat. No. 1,352,153.

Figure 6:
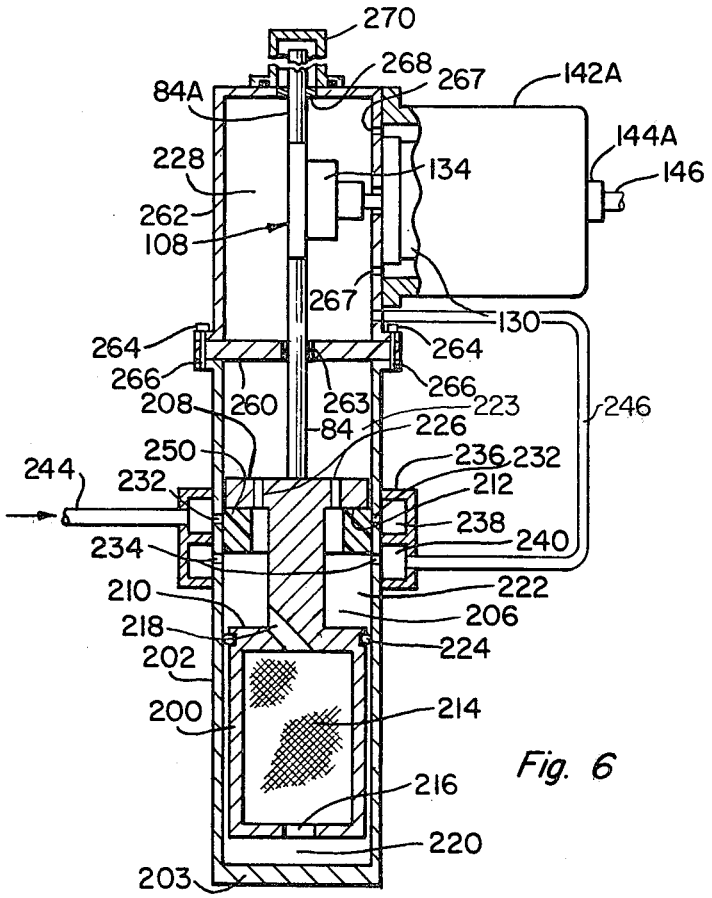
FIGS. 6 and 7 are views similar to FIG. 1 of other forms of the invention.
Figure 7:
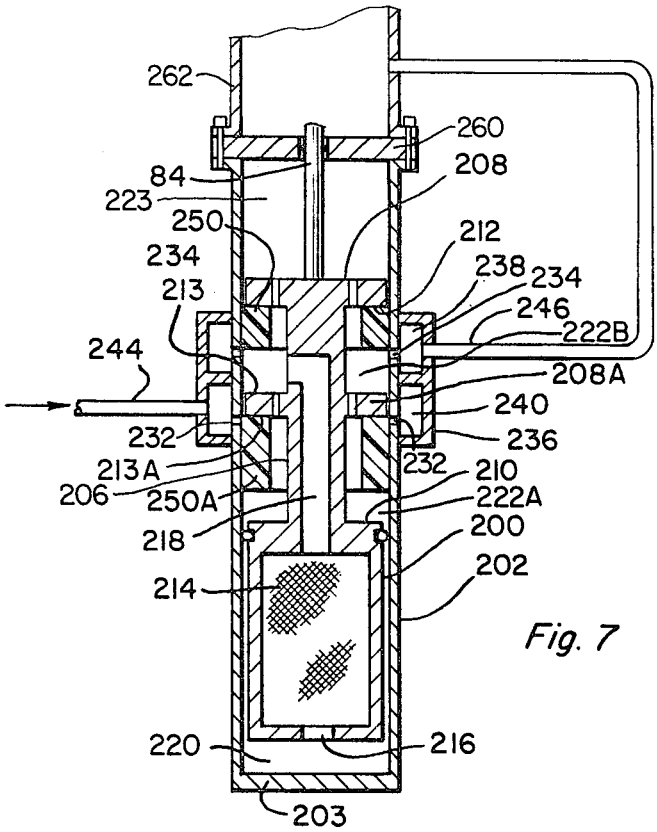

FIGS. 6 and 7 show two modifications of the present invention which involve the use of slide valves similar to those disclosed in British Pat. No. 1,352,153.

In the form of the apparatus shown in FIG. 6, a displacer 200 is located within a cylinder 202. The upper end of the displacer terminates in an extension 206 having a flange 208. Mutually confronting shoulders 210 and 212 are formed by the displacer at the lower end of the extension and by the flange at the upper end of the extension. The displacer 200 is hollow and contains a regenerator 214 which may be of any suitable material, e.g., phospher-bronze screens. Passageways 216 and 218 in the displacer permit the passage of gas between (a) the expansion chamber 220 formed between the displacer and the lower end of the cylinder and (b) the chamber or space 222 which is formed between the extension 206 and the cylinder. Chamber 222 moves lengthwise of the cylinder with the displacer. An O-ring seal 224 disposed in a groove in the upper end of the displacer adjacent to shoulder 210 prevents passage of gas into and out of the expansion chamber 220 as a consequence of by-passing the regenerator by flowing in the annular space formed by the clearance between the displacer and the cylinder. Flange 208 preferably lies close to the inner surface of cylinder 202 to help guide the displacer as it reciprocates and no effort is made to prevent gas passing between the flange and cylinder. One or more openings 226 in flange 208 allow rapid passage of gas from the space 222 into the space 223 formed between flange 208 and the upper end of the cylinder.

An inlet to the expansion chamber 202 is provided by a plurality of small, circumferentially located apertures 232 formed in the wall of the cylinder 202, and an outlet for that expansion chamber 202 is provided by a plurality of small, circumferentially located apertures 234 also formed in the wall of the cylinder 202 below the apertures 232. Surrounding the outer wall of cylinder 202 where the apertures 232 and 234 are disposed there is located a collar 236, which coacts with the wall of the cylinder to form annular manifolds 238 and 240 for the passage of gas flowing into the apertures 232 and out of the apertures 234. An inlet conduit 244 leading from a source of high pressure gas (not shown) communicates with manifold 238, while an outlet conduit 246 for the venting of gas exhausting from the expansion chamber 220 leads from manifold 240 to a low pressure gas source as hereinafter described.

Whether the outlet apertures or the inlet apertures are open to space 222 depends on the relative position of a valve member in the form of a ring 250 which is located within the cylinder in the annular space 222. Ring 250 is in frictional engagement with the inside surface of cylinder 202 and is made of a material selected so that the coefficient of friction between the ring and the cylinder is such that the ring will (a) remain in a given position until it is engaged by the displacer, (b) will move with the displacer in a first or a second direction so long as the displacer urges it in that direction, and (c) will stop in its instantaneous position when it is disengaged from the displacer. The valve ring is spaced from extension 222 so as to allow rapid passage of refrigerant gas, but its inner diameter is great enough for it to be intercepted by shoulders 210 and 212.

The valve ring has a length (the dimension measured along the axis of the cylinder) which is substantially greater than the maximum distance between inlet apertures 232 and outlet apertures 234, so as to prevent both sets of apertures from being open simultaneously. In order for the machine to produce efficient operation, the length of the valve ring, the spacing between apertures 232 and 234, and the spacing between shoulders 210 and 212 are arranged so as to permit (a) inlet apertures 232 to be closed and outlet apertures 234 to be open when the volume of expansion chamber 220 is being reduced in order to minimize the amount of gas compression occurring in the chamber at that time in the operating cycle, and (b) inlet apertures 232 to be open and outlet apertures 234 to be closed when the volume of expansion chamber 220 is being increased in order to permit the gas in the expansion chamber to expand and undergo cooling.

Improved cooling is achieved by spacing shoulders 210 and 212 so that the distance between them is sufficiently greater than the length of valve ring 250 to enable inlet ports 232 to be open for the greater part of the period during which the displacer is moving downward to reduce the volume of chamber 220, and to enable the inlet ports 232 to be open and the outlet ports 234 to be closed for the greater part of the period during which the displacer is moving upward to increase the volume of chamber 220.

The upper end of extension 206 is attached to a drive shaft 84 by means of which displacer 200 is reciprocated. The upper end of cylinder 200 is fitted with a header plate 260 which is adapted to carry one or more hermetic seals 263 which slidably guides shaft 84. Header body 260 is covered by a cap 262. Bolts 264 secure header plate 260 and cap 262 to a flange 266 on the upper end of the cylinder. Cap 262 carries a slide bearing 268 which guides shaft 84A, and an auxiliary cap member 270 accommodates the upper end of shaft 84A when the latter reaches the upper end of its operating stroke. Cap member 270 is hermetically sealed to the upper end of cap 262. As in the embodiment of FIGS. 1–3, shaft 84 is driven by an electric motor 130 acting through scotch yoke 108. The motor is enclosed by a housing 142A secured to cap member 262 by screws 143. Preferably motor 130 is cooled by the refrigerant exhausted from manifold 240. Accordingly cap 270 is formed with a transfer port to which is connected outlet conduit 246, motor housing 142A has an exhaust fitting 144A, and cap 262 has openings 267, whereby (a) the gaseous refrigerant at low pressure may be expelled from chamber 228 via the motor housing by the displacer as it moves upward, and (b) gaseous refrigerant or air will be drawn into chamber 228 by the displacer as the latter moves downward. This back and forth movement of gaseous fluid in housing 142A acts to cool motor 130. Preferably exhaust fitting 144A is connected to a conduit 146 that leads to the inlet side of a compressor, while the outlet side of the compressor is connected to inlet conduit 244.

In operation the displacer 2 is reciprocated by operation of motor 130. Pressurized refrigerant gas is supplied to the cylinder 202 via conduit 244 when valve ring 250 is located so as to expose inlets port 232; on the other hand, refrigerant gas is exhausted from the cylinder via the conduits 246 and 146 when the valve ring leaves the outlet ports 234 unblocked. As noted above, valve ring 250 will remain in any given position until it is moved out of that position by engagement by one of the shoulders 210 and 212.

With valve ring 250 located such that the inlet ports 232 are closed and the outlet ports 234 are opened, and with the displacer descending, gas is displaced from the expansion chamber 220 and passes through regenerator 214 via passages 216 and 218 into the space 222, and exits that space through outlet ports 234 and conduit 246.

During the descent of the displacer 2, the shoulder 212 contacts valve ring 250. As the displacer continues to descend, it displaces the valve ring so that the exhaust apertures 234 are closed and simultaneously the inlet apertures 232 are opened, thereby allowing a gas at high pressure to enter the cylinder through conduit 244 and the inlet apertures. The incoming gas passes through passageway 218, the regenerator 214 and passageway 216 into the expansion chamber 220. Unless the machine has just been started, the gas is cooled in passing through the regenerator which has been cooled by cold exhaust gas from the previous cycles. As the gas flows into the expansion chamber 220, the pressure therein is increased.

The displacer reaches its bottom limit position, is halted, and returned upward without striking the bottom end of cylinder 220. It can be seen that the exact position of the displacer in which the inlet apertures are opened and the outlet apertures are closed can be chosen by suitably positioning the location of the apertures 232 relative to the apertures 234. As the displacer moves up again, valve ring 250 remains in its bottom limit position which was reached when the displacer was halted. In this valve bottom limit position, apertures 232 are fully open and apertures 234 are fully closed by valve ring 250. The valve ring 250 remains in its bottom limit position covering apertures 234 until it is contacted again by shoulder 210 of the displacer as the latter continues moving upward. As the displacer moves upward, the volume of the expansion chamber 220 is increased thereby allowing more gas to enter that chamber from the inlet apertures 232 via passage 218, and the regenerator 214 and passage 216. This incoming gas maintains the pressure of the expansion chamber at the level of the gas pressure in inlet conduit 244.

As the displacer continues moving up, shoulder 210 contacts and pushes valve ring 250 into a position where the inlet apertures 232 are closed and the outlet apertures 234 are open. When this occurs, gas begins to exhaust from the expansion chamber 220, cooling the regenerator in its passage to the outlet ports 234.

When outlet apertures 234 are opened so that gas can be exhausted from the expansion chamber 220, the pressure in that chamber begins to fall and so the gas passing out of the device via conduits 246 and 146 is at a low pressure.

It is to be noted that chamber 223 is merely an extension of chamber 222 and hence the gas pressure on the upper side of flange 208 is the same as the gas pressure on its under side.

The timing of the displacement of valve ring 250 depends on the length of the path traveled by the displacer from the beginning of its upward or downward stroke until it contacts the valve ring. This length is equal to the difference between the length of ring 250 and the length of the space 222 (i.e., the spacing between shoulders 210 and 212).

With a machine as shown in FIG. 6, a surface may be cooled by heat exchange with the end surface 203 of the colder (expansion chamber) end of cylinder 202.

The form of the apparatus shown in FIG. 7 is generally similar to that of the machine shown in FIG. 6 except for the fact that the inlet and outlet apertures are reversed and two flanges 208 and 208A are formed on the displacer extension 206, so as to define three annular spaces 222A, 222B and 223. The space 222B is formed in part by mutually facing shoulders 212 and 213, and the space 222A is defined in party by mutually facing shoulders 213A and 210. The space 223 is between flange 208 and header plate 260 and communicates with space 22B which in turn communicates with space 222A. Flanges 208 and 208A lie close to the inside surface of cylinder 202 so as to provide guidance for the displacer as it moves. Apertures 226 in flanges 208 and 208A permit rapid movement of refrigerant gas among spaces 222A and B and 223. The passageway 218 extends between regenerator 214 and space 222B. Additionally, two valve rings 250 and 250A are located in the spaces 222B and 222A respectively, each of these rings being in frictional engagement with the inside surface of the cylinder 202 so as to remain in a given position lengthwise of the cylinder until it is moved by engagement by one of the shoulders of the displacer. The ring 250 acts as a valve member for the outlet apertures 234 while the ring 250A acts as a valve member for the inlet apertures 232. Preferably as shown in the drawings, the machine is designed such that the difference between the lengths of the ring 250 and its space 222B is greater than the difference between the lengths of the ring 250A and its space 222A. However, the machine may be made so that the two differences are equal.

In FIG. 7 the ring 250 is shown disposed so that the outlet apertures 234 are open while the ring 250A is in a position such that inlet apertures 232 are closed. Under these conditions, the gas in the expansion chamber 220 is at low pressure. If now the displacer is descending, it will displace gas from the expansion chamber 220, causing that gas to flow through the regenerator to exhaust through the apertures 234. With the displacer 2 descending the shoulder 213A abuts the ring 250A with the result that the ring is pushed downwards. As the displacer continues to descend, the shoulder 212 engages the ring 250 and pushes it downwards. The abutment of the shoulder 212 and ring 250 occurs before ring 250A is displaced sufficiently to open the inlet apertures 232. Indeed ring 250 closes the outlet apertures 234 simultaneously with the ring 250A uncovering the inlet apertures. With the inlet apertures now open, gas at a higher pressure flows into the expansion chamber 220, being precooled in passing through the regenerator 214 (except in the first cycle of operation of the machine). Consequently the pressure in the expansion chamber 220 increases. The displacer reaches its bottom limit position, stops, and then begins moving upwardly again, all without striking the lower end wall of cylinder 202.

On the upward stroke of the displacer, shoulders 210 engage and displace the ring 250A before the shoulder 213 of the displacer engages and displaces the ring 250. Consequently, the inlet apertures 232 are closed before the outlet apertures are opened, and there is a period during the upward stroke of the displacer when no gas enters or exhausts from the expansion chamber 220. The gas in the expansion chamber is expanded on the upward displacer stroke to provide particularly efficient cooling. In order to permit the rings 250 and 250A to be able to simultaneously close inlet apertures 232 and outlet apertures 234 during a portion of the upward stroke of the displacer, the difference between the lengths of the ring 250 and the recess 222B is made greater than the difference between the lengths of the ring 250A and the recess 222A. Further in order to enable the inlet apertures to be closed by the ring 250A relatively early in the stroke of the displacer, the difference in the length between the recess 222A and the ring 250A is made small. It is also desirable to make the ring 250A of sufficient length that the inlet apertures 232 are not reopened during the ascent of the ring 250A on the upward stroke of the displacer. The inlet apertures are closed relatively early during the upward stroke in comparision with the machine shown in FIG. 6.

It is to be noted that in the devices of FIGS. 6 and 7, the control valve differs from the device of FIGS. 1–4 in that it does not have a separate valve casing; instead a portion of the cylinder 202 forms the valve casing. Hence, the valves of FIGS. 6 and 7 are simpler than that of FIGS. 1 and 4.

Figure 3:
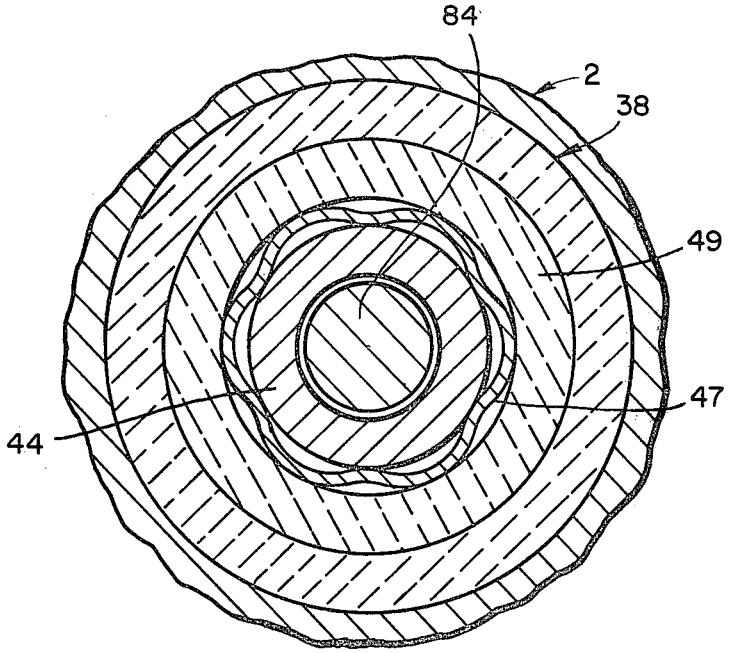
FIG. 3 is a cross-sectional view taken along line 3—3 of FIG. 2.

Of course, it is to be understood that the devices of FIGS. 6 and 7 also may be modified in many ways like the device of FIGS. 1–3, e.g., an external regenerator or an extra stage may be provided in the manner shown in FIGS. 5 and 6 of British Pat. No. 1,352,153.

Figure 8:
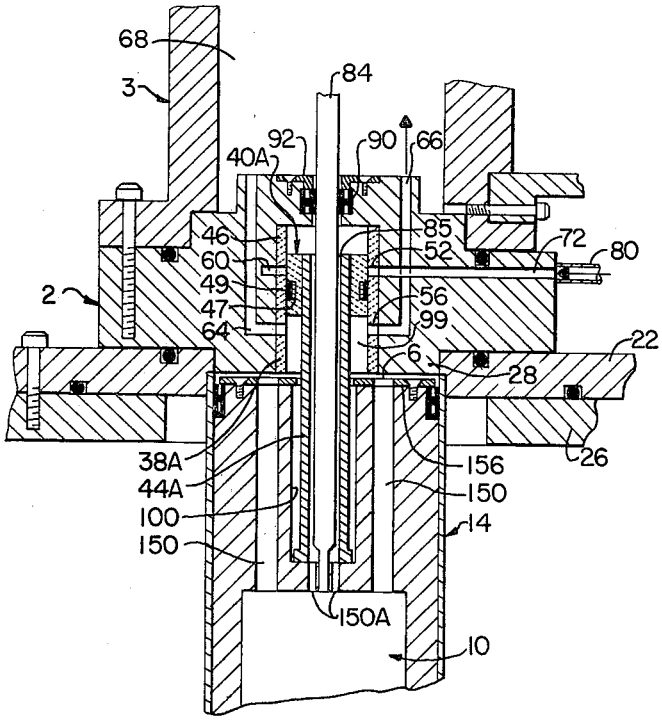
FIG. 8 is a fragmentary view of still another form of the invention.

FIG. 8 shows still another modification of the invention which is similar in many respects to the device of FIG. 1. In this case displacer 14 is provided with additional passageways for allowing high pressure gaseous refrigerant to enter the upper end of thermal regenerator 10 via the annular passageway 85 formed between shaft 84 and the sleeve 44A of slide valve 4A. The latter comprises a valve casing 38A and a slide valve member 40A. Valve casing 38A is secured in a bore section 34 in header 2 and is formed with two axially spaced sets of radial ports 52 and 56 of identical size. Formed in header 2 in radial alignment with ports 52 and 56 are two annular grooves 60 and 64 with the same axial dimensions as ports 52 and 56. Groove 60 communicates with a passageway 72 which leads to an inlet port fitted with an inlet pipe 80 for high pressure refrigerant fluid. Groove 64 leads to a passageway 66 which leads into a chamber 68 formed by header cap 3. Although not shown, it is to be understood that the apparatus of FIG. 8 has a motor connected to shaft 84 by a scotch yoke mechanism and that the motor is enclosed by a motor housing which communicates with chamber 68 and has an exhaust fitting for coupling the chamber to a source of low pressure gas, in the manner shown in FIGS. 1–4.

The lower end of valve casing 38A is open and communicates with the variable volume chamber 6 formed between the extension 28 of header 2 and the upper end of displacer 14. Valve member 40A comprises the sleeve 44A and a ceramic ring 46 attached to the upper end of the sleeve. Ring 46 has an external groove in which is located a washer-like spring 47 and a friction ring 49 as previously described. Spring 47 holds ring 49 against valve casing 38 so that the valve member will not move in the valve casing unless forced to do so by the displacer. The bottom end of sleeve 44A has a peripheral flange 49 which is sized so that it will not rub against the inner surface 100 of the displacer yet will be intercepted by the retainer plate 156. The axial length of ring 46 is set so as to be the same as the distance between the upper edges of ports 52 and the lower edges of ports 56. In this way ring 46 may be positioned so as to close off ports 52 and 56 simultaneously. Additionally the length of sleeve 44A is set so that (a) when the displacer moves upward to its TDC position it will force the valve member to a top limit position in which the lower edge of ring 46 is even with or just above the upper edges of ports 56, so that ports 56 are fully open and ports 52 are fully closed, and (b) when the displacer moves down to its BDC position, it will force the valve member to a bottom limit position in which the upper edge of ring 46 is even or just below the lower edges of ports 52, so that ports 52 are fully open and ports 56 are fully closed. As a consequence when the valve is in its upper limit position (FIG. 8), gas will exhaust from displacer 14 via passageways 150, the passageway 99 formed between sleeve 44A and casing 38A, ports 56, groove 64 and passageway 66. When the valve is in its lower limit position, high pressure gas will enter the displacer via passageway 72, groove 60, ports 52, annular space 85 and passageways 150A. The refrigeration process is characterized by the same Gifford-McMahon cycle as the systems of FIGS. 1–7.

Still other modifications and advantages will be obvious to persons skilled in the art.

What is claimed is:

1. In a cryogenic refrigerator in which (a) fluid under pressure is cooled by heat exchange and expansion in the course of its being transferred into and out of a chamber of variable volume via a thermal regenerator, (b) transfer of the fluid is achieved by reciprocal movement of displacer means and (c) a cyclically operating valve means controls introduction of high pressure fluid to and discharge of low pressure fluid from that chamber, the improvement comprising a displacer, cylinder means cooperating with the displacer so as to define first and second chambers with said first chamber having a volume which varies according to movement of the displacer within the cylinder means, conduit means and a thermal regenerator connecting said first and second chambers, means connected to said displacer for reciprocating said displacer in said cylinder means, and a control valve for controlling the flow of a refrigerant fluid to and from said first chamber, said control valve comprising a high pressure inlet port, a low pressure outlet port, and a valve member movable between first and second positions and arranged so that it connects said inlet and outlet ports to said second chamber when in said first and second positions respectively, and means for (a) causing said valve member to be shifted to said first position by said displacer as said displacer moves in a first direction and (b) causing said valve member to be shifted to said second position by said displacer as said displacer moves in a second opposite direction.

2. Apparatus according to claim 1 wherein said means for reciprocating said displacer comprises an electric motor.

3. Apparatus according to claim 2 wherein said means for reciprocating said displacer comprises a scotch yoke connection between said motor and said displacer.

4. Apparatus according to claim 1 wherein said means for reciprocating said displacer is operable independently of said control valve.

5. Apparatus according to claim 1 wherein said thermal regenerator is contained within said displacer.

6. Apparatus according to claim 1 wherein the volume of said second chamber varies according to movement of said displacer.

7. Apparatus according to claim 1 wherein said first and second chambers are at opposite ends of said displacer.

8. Apparatus according to claim 1 wherein said control valve is coaxial with said displacer.

9. Apparatus according to claim 1 wherein said control valve has a valve casing formed separately from said cylinder.

10. Apparatus according to claim 1 wherein said valve casing comprises part of said cylinder.

11. Apparatus according to claim 1 wherein said valve member is annular and surrounds an extension of said displacer.

12. Apparatus according to claim 1 wherein said control valve comprises a ceramic valve casing and said valve member has at least one ceramic surface in sliding engagement with said valve casing.

13. Apparatus according to claim 1 wherein said control valve casing has a transfer port communicating with said second chamber and said valve member is arranged so as to alternately connect said inlet and outlet ports to said transfer port.

14. Apparatus according to claim 13 wherein said valve casing has a plurality of inlet ports, outlet ports and transfer ports, and further including an inlet manifold chamber communicating with said inlet ports, an outlet manifold chamber communicating with said outlet ports, a transfer manifold chamber communicating with said transfer ports, means for connecting said inlet and outlet manifold chambers to sources of high and low pressure refrigerant fluid, and means connecting said transfer manifold to said second chamber.

15. In a cryogenic refrigerator in which (a) fluid under pressure is cooled by heat exchanger and expansion in the course of its being transferred into and out of a chamber of variable volume via a thermal regenerator, (b) transfer of the fluid is achieved by reciprocal movement of displacer means and (c) a cyclically operating valve means controls introduction of high pressure fluid to and discharge of low pressure fluid from that chamber, the improvement comprising a displacer, cylinder means cooperating with the displacer so as to define first and second chambers with said first and second chambers having a volume which varies according to movement of the displacer within the cylinder means, conduit means and a thermal regenerator connecting said first and second chambers, drive means connected to said displacer for reciprocating said displacer in said cylinder means, and a control valve for controlling the flow of a refrigerant fluid to and from said first chamber, said control valve comprising a high pressure inlet port, a low pressure outlet port, and a valve member movable between first and second positions and arranged so that it connects said inlet and outlet ports to said second chamber when in said first and second positions respectively, and means for (a) causing said valve member to be shifted to said first position by said displacer as said displacer moves in a first direction and (b) causing said valve member to be shifted to said second position by said displacer as said displacer moves in a second opposite direction.

16. Apparatus according to claim 15 wherein said drive means is connected to said displacer by mechanical means extending through said valve member.

* * * * *